United States Patent [19]

Dechelette et al.

[11] 4,060,890

[45] Dec. 6, 1977

[54] METHOD OF MANUFACTURING AN ELECTRICAL HARNESS

[75] Inventors: Helen Dechelette, St. Cloud; Jean Claud Joly, Osny, both of France

[73] Assignee: AMP Incorporated, Harrisburg, Pa.

[21] Appl. No.: 756,656

[22] Filed: Jan. 4, 1977

[30] Foreign Application Priority Data

May 12, 1975 France ..... 75.14747

Related U.S. Application Data

[62] Division of Ser. No. 682,924, May 4, 1976, Pat. No. 4,026,629.

[51] Int. Cl.[2] ..... H01R 43/00

[52] U.S. Cl. ..... 29/628; 29/742; 29/748; 29/757; 29/759; 29/760

[58] Field of Search ..... 29/628, 742, 757, 759, 29/760, 747, 748, 749; 339/97, 98, 99, 220, 221

[56] References Cited

U.S. PATENT DOCUMENTS

| | | | |
|---|---|---|---|
| 2,827,617 | 3/1958 | Odegaard | 339/97 |
| 3,456,325 | 7/1969 | Langlois et al. | 29/747 X |
| 3,772,571 | 11/1973 | Merry et al. | 339/97 R X |
| 3,824,527 | 7/1974 | Evans | 339/97 R |
| 3,874,764 | 4/1975 | Volinskie | 339/97 R |

*Primary Examiner*—Victor A. DiPalma
*Attorney, Agent, or Firm*—Allan B. Osborne

[57] ABSTRACT

In a method of manufacturing an electrical harness comprising wires connected to electrical terminals of a plurality of electrical connectors, according to a desired wiring pattern, each terminal comprises a wire connecting portion in the form of a slotted plate formed integrally with a contact portion in the form of an electrical receptacle. The wires are laid out on a wiring layout board with the aid of wire guiding posts to form a desired wiring pattern, with portions of the wires extending through notches in the housings of the connectors. The terminals are then inserted into through openings in the housings so that the wires received in the notches are captured by the slots of the terminals so that electrial connection is made between the terminals and the wires. When the terminals have been inserted into the openings in the housings, the receptacles are in line with the ends of the openings opposite to those through which the terminals were inserted, so that the receptacles can receive male members inserted through the former ends of the openings. The openings in the housings, contain abutments for forcing the wires into the slots of the terminals as the terminals are inserted into the openings.

7 Claims, 17 Drawing Figures

FIG.3.
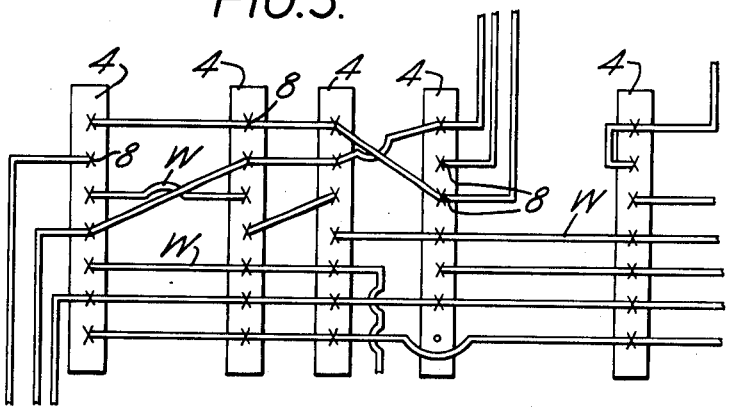
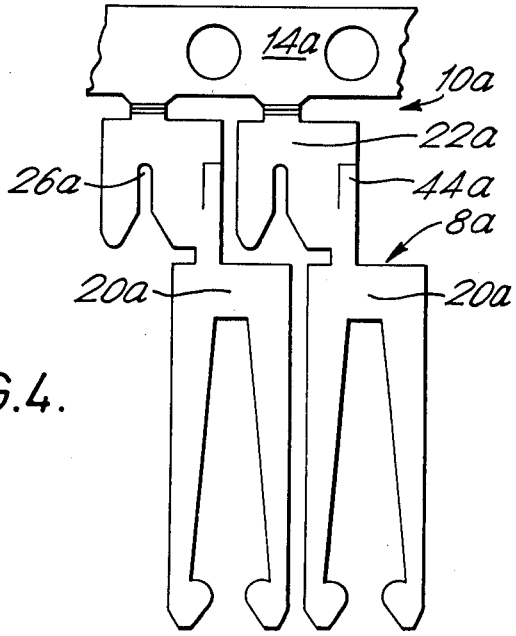
FIG.4.

200
202
204
206
208
210
211
212
214
215
216
217
218
220
222
224
226
228
230
232
234
236
238
240
242
244

METHOD OF MANUFACTURING AN ELECTRICAL HARNESS

This is a division of application Ser. No. 682,924, now U.S. Pat. No. 4,026,629, filed May 4, 1976.

BACKGROUND OF THE INVENTION

This invention relates to a method of manufacturing an electrical harness comprising wires connected to electrical terminals of a plurality of electrical connectors and to electrical connectors and terminals for carrying out the method.

The invention has particular application to the provision of electrical harnesses for electrical apparatus, for example for domestic television receivers.

We have described in our U.S. Pat. No. 3,772,571, a method of manufacturing an electrical harness comprising wires connected to electrical terminals received in terminal-receiving through openings in electrical connector housings, in which method the wires are initially laid out on a wiring layout board with the aid of wire guiding posts on the board, to form a desired wiring pattern for the electrical harness, with the wires extending through notches in the connector housings. Prior to the wires being dressed in this way, the housings are loaded with electrical terminals each comprising at one end, a receptacle for receiving a flat electrical tab and at the other, a socket for receiving a metallic wedge member. When the wires have been dressed, the wedge members are inserted into the openings of the housings so as to enter the sockets of the terminals, each wedge member trapping a wire extending through a pair of opposed notches in the housing, between the wedge member and the internal wall of the socket so that the terminal is connected to the wire.

This known method not only has the disadvantage, that the housings must be preloaded with terminals before the insertion of the wedge members, but that the insertion forces of the wedge members are such that it is necessary for the housings to be produced in the form of separate parts which are subsequently secured together about the terminals so that rigid shoulders on the terminals engage with rigid shoulders within the openings of the housings, in overlapping relationship to provide counterabutment means against the high wedge insertion forces.

It is desirable that such a method should be capable of being carried out with the aid of housings that can be molded in one piece rather than being molded in the form of two pieces which must be subsequently secured together and that each terminal should comprise only a single part instead of a plurality of parts.

BRIEF STATEMENT OF THE INVENTION

It is a primary object of the invention to provide a method of manufacturing an electrical harness comprising wires connected to electrical terminals of a plurality of electrical connectors, in which the starting materials are simply the wires, unloaded connector housings, and a single terminal for making each connection with a wire.

It is another object of the invention to provide such a method, in which each housing may be initially molded in a single piece and in which each terminal performs both a wire connecting function, and the function of mating with a complementary electrical terminal.

It is a further object of the invention to provide an electrical connector, the housing of which is adapted to cooperate with a terminal, as it is inserted into the housing, to force the wire into a slot of a slotted plate carried by the terminal.

It is a further object of the invention to provide a terminal which is suitable for use in carrying out the method of the invention and which is sufficiently rigid to withstand the insertion operation.

It is another object of the invention, to provide a harness making method, which can readily be performed either manually, semi-automatically, or fully automatically as circumstances may warrant.

According to one aspect of the invention there is provided a method of manufacturing an electrical harness comprising wires connected to electrical terminals of a plurality of electrical connectors, according to a desired wiring pattern each terminal comprising a wire connecting portion formed integrally with a contact portion for mating with a complementary electrical terminal member, in which method the wires are laid out on a wiring layout board, with the aid of wire guiding means, to form the desired wiring pattern and are subsequently connected electrically, to the terminals of the connectors, the wires being first laid in notches in the housings of the connectors, which housings are disposed on the board, after which the terminals are inserted into through openings in the housings through first ends of the openings, electrically to connect the wires to the wire connecting portions of the terminals and are secured in the openings with the contact portions of the terminals positioned to receive mating terminal members inserted through second ends of the openings in the housings.

According to another aspect of the invention there is provided an electrical connector comprising an insulating housing and a plurality of electrical terminals therefor, the housing having a plurality of terminal-receiving through openings having first and second ends, a wall of the housing being provided with notches each opening into an edge of the wall, the first end of each opening having therein an abutment opposite to such a notch, each terminal being adapted to be received in one of the openings and having a contact portion for mating with a complementary electrical terminal member and a wire connecting portion having means for piercing the insulation of an insulated wire to make electrical contact with the electrically conductive core of the wire, the contact portion and the wire connecting portion of each terminal being disposed opposite to one another with the insulation piercing means of the wire connecting portion directed towards the contact portion, each terminal being dimensioned to be inserted, with its contact portion leading, through the first end of the opening to cause a wire laid in the notch associated with such openings to be forced by the aubtment against the insulation piercing means of the wire connection portion of the terminal to cause the insulation piercing means to make electrical contact with the electrically conductive core of the wire, with the contact portion of the terminal aligned with the second end of the opening to mate with a complementary terminal member inserted through such second end, each terminal having means for cooperation with the housing to lock the terminal in its inserted position in the opening.

According to yet a further aspect of the invention there is provided an electrical connector in which the plate is formed with a reinforcing rib extending alongside the slot in the plate, the receptacle being carried by an arm extending in the same direction as the slot in the plate, and being laterally offset therefrom, the arm having a longitudinal reinforcing rib.

According to yet a further aspect of the invention there is provided an electrical terminal comprising a receptacle portion for mating with a complementary male contact member and a wire connecting portion in the form of a plate having a slot to receive an insulated electrical wire so that the edges of the slot pierce the insulation of the wire to make permanent electrical contact with the electrically conductive core of the wire, the slot opening in the direction of the receptacle portion, the plate being formed with a linear reinforcing rib extending along one side of the slot, the receptacle portion of the terminal being carried by an arm extending in the same direction as the slot and having formed therein a longitudinal stiffening rib, opposite edges of the plate on either side of the slot being formed with projections for locking the terminal in a housing with a wedging action.

BRIEF DESCRIPTION OF THE FIGURES

The above and other objects and features of the invention will be more fully understood from the following detailed description thereof when read in conjunction with the accompanying drawings:

FIG. 3 is a diagram illustrating the layout of an electrical harness which may be manufactured by means of the method illustrated in FIG. 1;

FIG. 4 is an enlarged fragmentary view of a strip of electrical terminals;

As shown in FIG. 1, electricl connector housings 4 one of which is shown in detail in FIG. 2, are arranged in a row in parallel constantly spaced relationship upon a wiring layout board 3. As shown in FIG. 2, each housing 4, which is made of electrically insulating material, has a row of through openings 6 each for receiving an electrical terminal 8. The terminals 8 are comprised in two strips 10 and 12, and are connected together in side-by-side relationship by metal carrier bands 14 with which the terminals 8 are formed integrally. The strips 10 and 12 each of which may comprise several hundred terminals 8, are wound about rotary storage spools 16 and 18, respectively, as shown in FIG. 1. Each terminal 8 consists of a receptacle portion 20 having a pair of contact arms for receiving between them a male member in the form, for example, of a printed circuit panel, and a U-shaped wire connecting portion 22 comprising parallel sidewalls 24 each provided with a slot 26 opening into an edge of the sidewall 24. The slots 26 of each portion 22 are arranged in alignment with one another, each such slot comprising a flared mouth merging into a narrower conductor gripping portion of constant width. The portion 22 of each terminal 8 is connected to the respective carrier band 14 by a slug 28. The spacing between the terminals of each strip 10 and 12 along the carrier band 14 of the strip is determined by the amount of metal required to form the portions 22 of the terminals since both the terminals 8 and the carrier band 14 of each strip are stamped and formed from a single length of sheet metal stock. Since a considerable area of metal is required to make each portion 22 in view of its U shape, the terminals 8 are commensurately widely spaced from one another.

Figure 1:
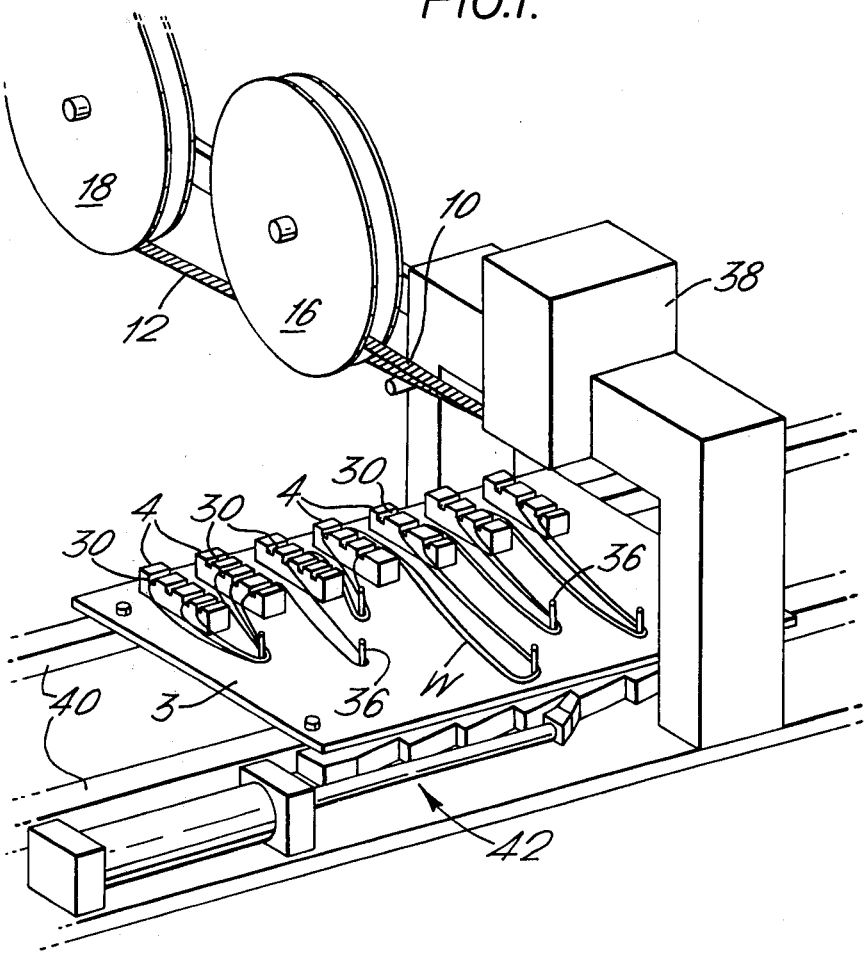
FIG. 1 is a diagrammatic perspective view, shown partly schematically, illustrating a method, according to a first embodiment of the invention, of manufacturing of electrical harness.

The spacing between the terminals should correspond exactly to the spacing between the openings 6 of the housing 4. Two opposite sidewalls 7 of each opening 6 are provided with wire receiving notches 30, the notches 30 associated with each opening 6 being aligned and opening in the same direction. Arranged midway between, and being spaced from, both sidewalls 7 of each opening 6, as well as being spaced from the adjacent sidewall 9 of the opening 6, is a saddle 32, a terminal guide bar 34 depending from each saddle 32.

As shown in FIG. 1, the board 3 is provided with wire guide posts 36.

The board 3 is slidably mounted in guides 40 and is arranged to be advanced there along by a piston-and-cylinder driven rack and pawl device 42 towards and beneath a terminal inserter 38 (shown only schematically) mounted above the guides 40 on a C-frame to which the spools 16 and 18 are attached.

Figure 2:
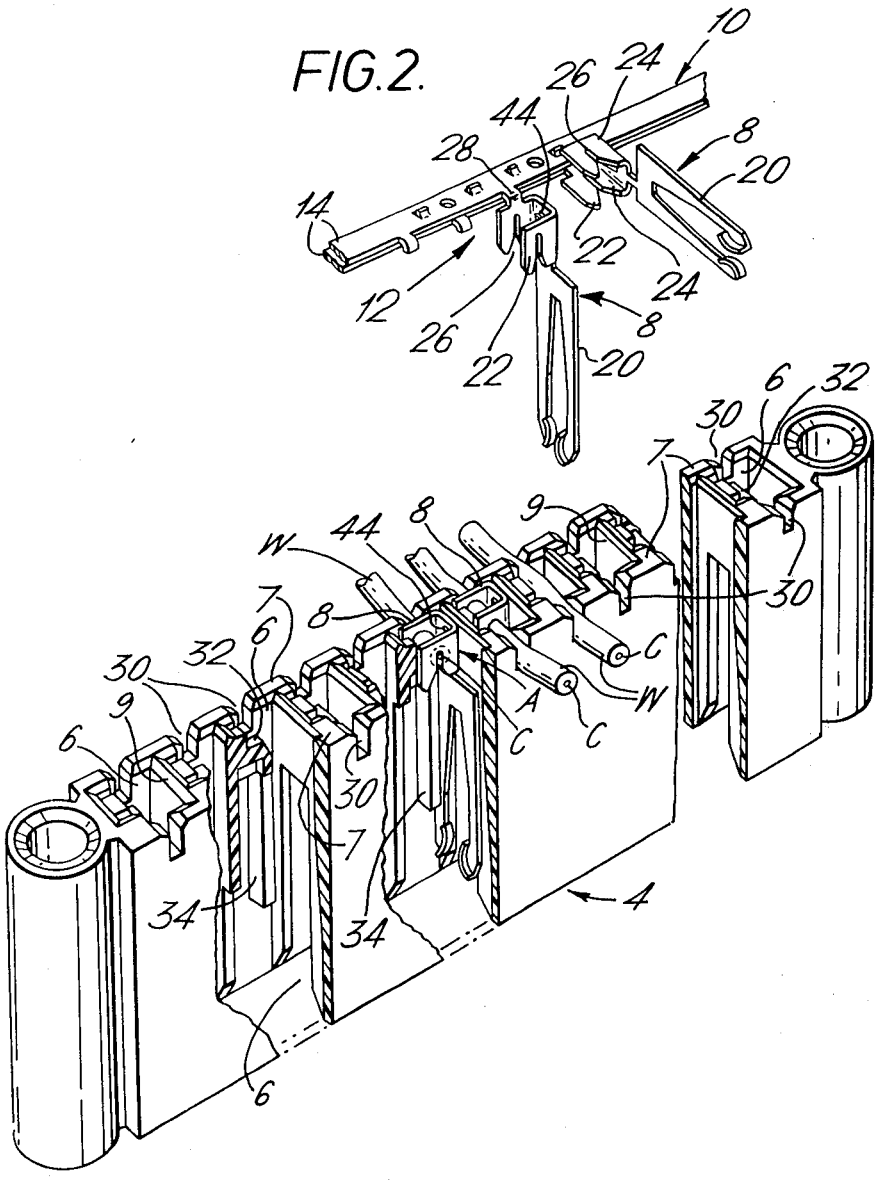
FIG. 2 is an enlarged perspective view, shown partly in section, of an electrical connector for use in carrying out the method illustrated in FIG. 1 and also showing in fragmentary form, strips of electrical terminals to be inserted in the housing of the connector.

The strips 10 and 12 are fed to the inserter 42 from the spools 16 and 18 in superposition as shown in FIG. 2, with each terminal of one strip extending between a pair of terminals of the other strip. The terminals of each strip, then extend in the direction of the plane of the carrier band 14 of the strip, as shown in the case of the right hand terminals (of the strip 12) in FIG. 2.

The strips 10 and 12 are so fed that the terminals 8 are presented to the inserter 38 in batches of terminals, the number of terminals in each batch corresponding to the number of openings 6 in a housing 4.

To produce an electrical harness, insulated electrical wires W are laced about the guide posts 36 and are inserted into selected notches 30 of the housings 4 to produce a desired harness pattern, for example a pattern according to FIG. 1 or FIG. 3, the wires W; being retained in the notches 30 by virtue of their own resilience.

The board 3 is then stepped along guides 40 by means of the device 42 to position the right hand (in FIG. 1) housing 4 beneath the inserter 38. An insertion head (not shown) of the inserter 38 bends down each of the terminals presented thereto, at right angles to the carrier bands 14, as shown in the case of the left hand terminal (of the strip 10) in FIG. 2, and then severs the slugs 28 of these terminals from the carrier bands 41 simultaneously and then simultaneously inserts each terminal 8 into one of the openings 6 in the housing 4 beneath the inserter 38. Each terminal is inserted into its opening 6, in such a way that the portion 22 of the terminal straddles the saddle 32 in the opening 6, the wire held in the notches 30 associated with that opening entering the slots 26 of the terminal, the saddle 32 acting as a counter abutment.

The mouths of the slots 26 serve to guide the terminal with respect to the wire W so that the wire is driven into the narrower wire receiving part of the slot, the edges of which pierce the insulation of the wire so as to make permanent electrical connection with the central conductor C of the wire as shown at A in FIG. 2. When the terminal 8 has been fully inserted into the opening 6, a locking lance 44 on the bight of the U formed by the portion 22 of the terminal engages the adjacent wall 9 of the opening 6 so that the terminal 8 is retained in its fully inserted position. The notches 30 and the wire should be so relatively dimensioned that the wire is tightly gripped by the notch walls to provide strain relief for the connections.

In the interest of simplification, the terminals 8 may be replaced by terminals as shown in FIG. 4. The same reference numerals are used in FIG. 4 as in FIG. 2, to indicate parts having the same function, but with the addition of the index *a*. The terminals 8*a* of the strip 10*a* in FIG. 4 differ from the terminals 8 of FIG. 2, in that their wire connecting portions 22*a*, instead of being U-shaped are in the form of a single slotted plate. Since less metal is used to form this single plate than the U-shaped portions 22 of the terminals 8, the terminals may be more closely spaced along the carrier band 14*a* than the terminals 8 of FIG. 2 are spaced along the carrier bands 14, so that the spacing between the terminals 8*a* on the single carrier band 14*a* corresponds to the spacing between the openings of the insulating housing. The use of two strips of terminals is thereby avoided. Where the terminals 8*a* are used, the saddle in each aperture of the housing has formed therein, a slot extending in the longitudinal direction of the housing, for receiving the portion 22*a* of a terminal 8*a*.

The method described above may be performed manually instead of automatically, in which case the connector housings are arranged on a wiring layout board, the wires are laid out on the board with the aid of wire guiding means and are inserted into the notches of the housings, the terminals, in strip form, are partially inserted into the openings in the housings and the terminals are severed from the strip and are pushed home into the openings. For use in this manual method, the terminals are preferably as shown in FIG. 4.

Where the wires have stranded conductors, the saddles in the openings of the housings are preferably made resilient.

Figure 5:
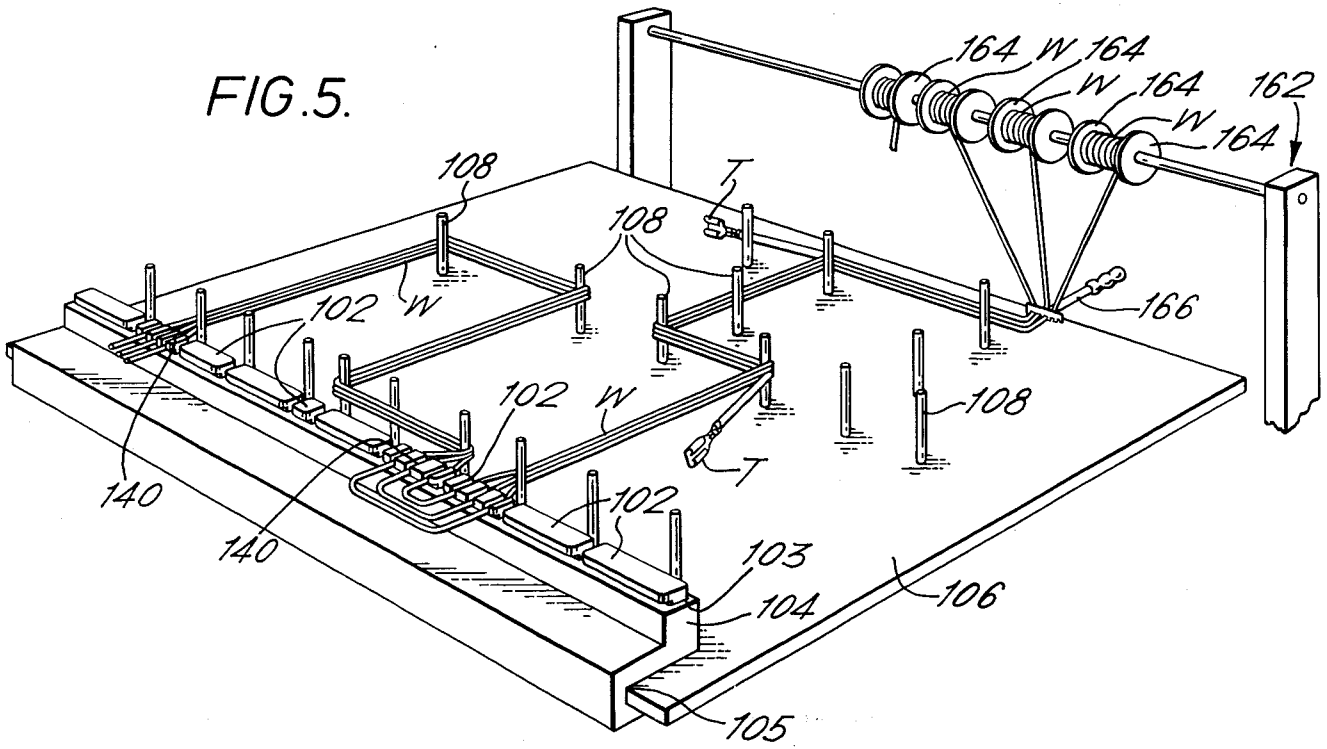
FIG. 5 is a diagrammatic perspective view, illustrating the use of a wiring layout board assembly in a method, according to a second embodiment of the invention, of manufacturing an electrical harness.
Figure 6:
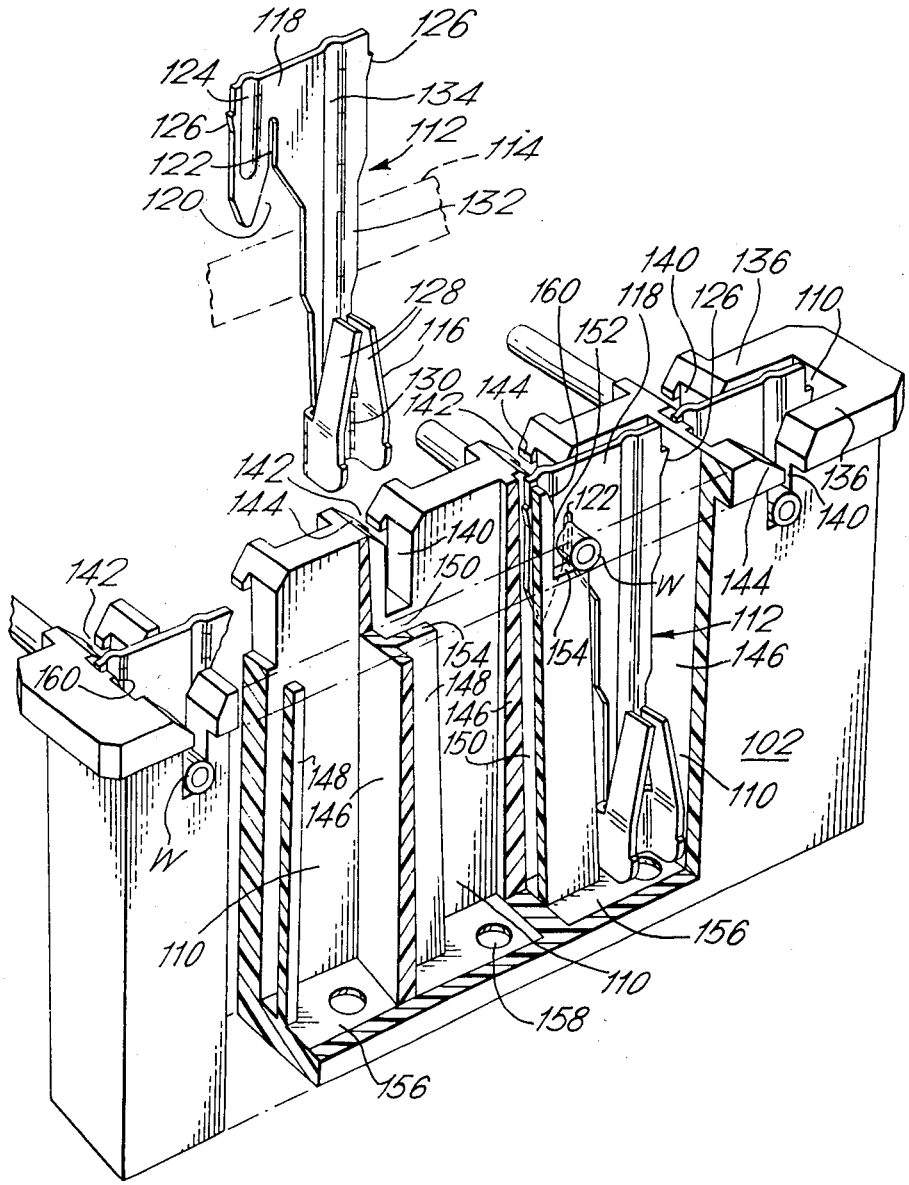
FIG. 6 is an enlarged perspective view, shown partly in section and with parts removed, of an electrical connector having an insulating housing for use with the layout board assembly illustrated in FIG. 5 and also showing a terminal of a strip of electrical terminals to be inserted in the housing.

As shown in FIG. 5, electrical connector housings 102 of different lengths, one of which is shown in detail in FIG. 6, are arranged in a row in end to end relationship in recesses 103 in a support block 104 having a longitudinal slot 105 receiving an edge portion of a wiring layout board 106 having wire guide posts 108 projecting from its upper as seen in FIG. 6 surface. As shown in FIG. 6 each housing 102, which is made of electrically insulating material, has a row of openings 110 each for receiving an electrical terminal 112. The openings 110 may be irregularly spaced for polarization purposes. The terminals 112 (prior to insertion in the openings 110 as will be described below), are comprised in a strip of terminals connected together in side-by-side relationship by metal slugs 114 (shown in broken lines) with which the terminals 112 are formed integrally.

Each terminal 112, which has been stamped and formed from a single piece of metal, consists of a receptacle portion 116 for receiving a male terminal member (not shown) in the form, for example, of a pin or post, and a wire connecting portion comprising a plate 118 provided with a slot opening into an edge of the plate 118, the slot comprising a flared mouth 120 merging into a narrower conductor gripping portion 122 of constant width. The plate 118 has a linear stiffening rib 124 formed therein and extending along one side of the portion 122 of the slot. Locking projections 126 are formed in opposite edges of plate 118. The mouth 120 opens in a direction towards the receptacle portion 116.

The receptacle portion 116 comprises a pair of opposed contact springs 128 formed as extensions of the arms of a U-cross-section support member 130, the contact springs 128 converging towards the plate 118. The member 130 is connected to the plate 118 by a rigid support arm 132 having a central longitudinal stiffening rib 134 formed therein.

Sidewalls 136 of each housing 102, are each provided with wire receiving notches 140, the notches of one side wall being aligned with those of the other. Each notch 140 has a flared mouth 142 defining a pair of opposed wire retaining projections 144 at the base of the mouth 142. The openings 110 are separated by barriers 146 of T-shaped cross-section each having an arm 148 projecting into one of the openings 110 to define a slot 150 in cooperation with one of the side walls 136, such slot being dimensioned to receive the plate 118 of one of the terminals 112. Each barrier 146 has a notch 152 providing a wire anvil 154 facing in the outward direction of, and aligned with, a pair of notches 140.

Each openings 110 has a base 156 having a circular hole 158 for the introduction of a male member into the opening 110, from below, as seen in FIG. 6. Each arm 148 has a chamfered wire guiding face 160 at its upper (as seen in FIG. 6) end. In the case of the left hand (as seen in FIG. 6) opening 110 the arm 148 extends from an end wall of the housing instead of from a barrier 146.

In the production of an electrical harness, for use for example in the manufacture of a domestic television receiver, the block 104 with the wiring layout board 106 received in the slot 105 of the block 104 and housings 102 assembled in the recesses 103 of the block 104 is positioned as shown in FIG. 5 at a wiring layout station at which is a support 162 carrying a series of rotary spools 164 each wound with an insulated wire W to the free end of which an electrical terminal T may have been applied. Selected wires W pulled from the spools 164 are held in position on the board 106 by a comb tool 166, the free ends of the wires being led about the posts 108 in accordance with a desired wiring pattern. Intermediate portions of the wires W are pressed into notches 140 of the housings 102, also in accordance with the wiring pattern, guided by the flared mouths 142 of the notches, and the faces 160 of the arms 148, past the projections 144 so that the wires are retained in the notches 140 thereby.

Figure 7:
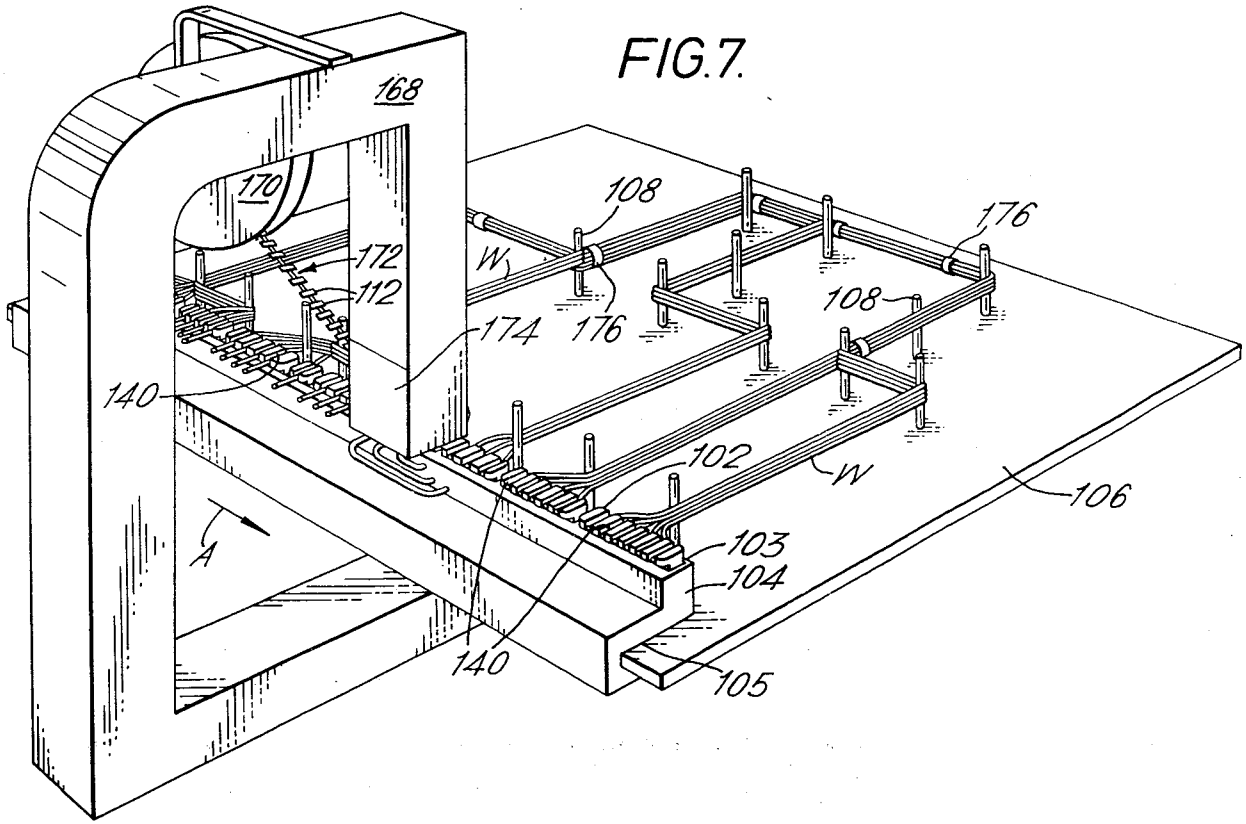
FIG. 7 is a diagrammatic perspective view illustrating the use of a terminal insertion machine with the layout board assembly of FIG. 5 when the layout board thereof has been wired as described below with reference to FIG. 5.

The block 104 and board 106 are then transferred to a terminal insertion station (FIG. 7) at which is a terminal inserter 168 (shown only schematically) upon which is mounted a rotary spool 170 about which is wound a strip 172 of the terminals 112. The block 104 and board 106, are advanced together in the direction of the arrow A in FIG. 7, beneath an insertion head 174 of the inserter 168. In FIG. 7, the block 104 is shown in mid-passage past the insertion head 174. As each opening 110 is passed beneath the head 174, a terminal 112 severed from the strip 172 by the inserter is inserted by the head 174 into such opening 110, the receptacle portion 116 of the terminal 112 leading and passing into the opening 110 until support member 130 of the terminal engages the base 156 of the opening 110, in alignment with the hole 158 therein. During the insertion of the terminal 112 the wire W extending through the two notches 140 associated with the opening 110 is captured by the mouth 120 of the plate 118 of the terminal 110 and is forced (see FIG. 6) into the slot portion 122 therefore by the anvil 154 as the plate 118 is driven home into the slot 150 in the opening 110. The walls of the slot portion 122 pierce the insulation of the wire and grip the electrically conductive core of the wire from either side. Also during the insertion of the terminal, the locking projections 126 thereon wedgingly engage the barriers 146 bounding the opening 110 or one of these barriers at an end wall of the housing, as the case may be, whereby the terminal is securely fixedly in position in the opening 110 so that permanent electrical connection between the wire core and the terminal is ensured.

The block 104 may be advanced for example by means of a tape programed carriage (not shown) in such a way that a terminal 112 is inserted into each opening 110 across which a wire W has been positioned, in spite of the fact that no wire may have been positioned across some of the openings 110 and the fact that the openings 7 may be irregularly spaced in the direction of advance of the block 104 and board 106.

When the whole length of the block 104 has been passed beneath the inserter head 174, the housings 102 are removed from the recesses 103 in the block 104 and the wires W are removed from the pins 108, at a harness removal station (not shown). Prior to or after the insertion operation, the wires may be secured together in bundles, by means of bundle ties 176.

When the wires W have been loaded into the housings 102 and prior to the insertion of the terminals 112, the wire ends projecting from the housings 102 on the insertion side of the block 104 may be trimmed for example by cooperation between stationary and fixed shear blades (not shown).

Figure 8:
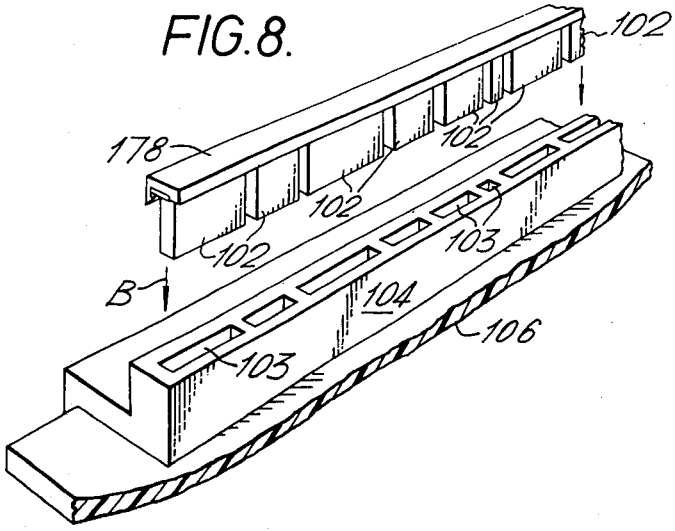
FIG. 8 is an enlarged fragmentary perspective view illustrating a manner in which the layout board assembly of FIG. 5 may be loaded with electrical connector housings.

As shown in FIG. 8, a series of the housings 102 may be detachably secured in a resilient strip 178, for example of synthetic plastics material, to form a cartridge, for loading the block 104, the housings being arranged along the strip 178 in a size sequence corresponding to that of the recesses 103 in the block 104. To load the block 104, the strip 178 is placed above the block 104 and is advanced in the direction of the arrow B in FIG. 4 to position each housing 102 in a corresponding recess 103. The strip 178 is removed from the housings prior to their being loaded with wires W. The housings may, however, be fed into the recesses 103 by means for example, of a vibratory bowl feeding device (not shown).

As well as ordinary insulated wires, cut and stripped shielded wires may be loaded into the housings 102 for inclusion in the harness.

Figure 9:
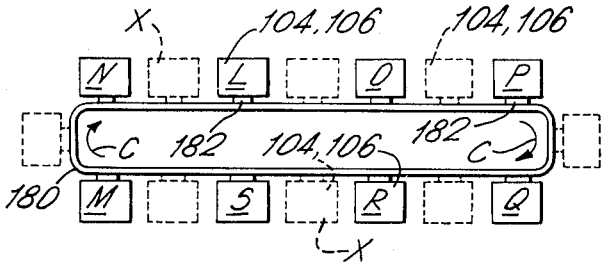
FIG. 9 is a block-schematic plan view of electrical harness making apparatus for use in carrying out the method illustrated in FIGS. 5 to 8.
Figures 10, 11, 12, 13, 14, 15, 16, 17:
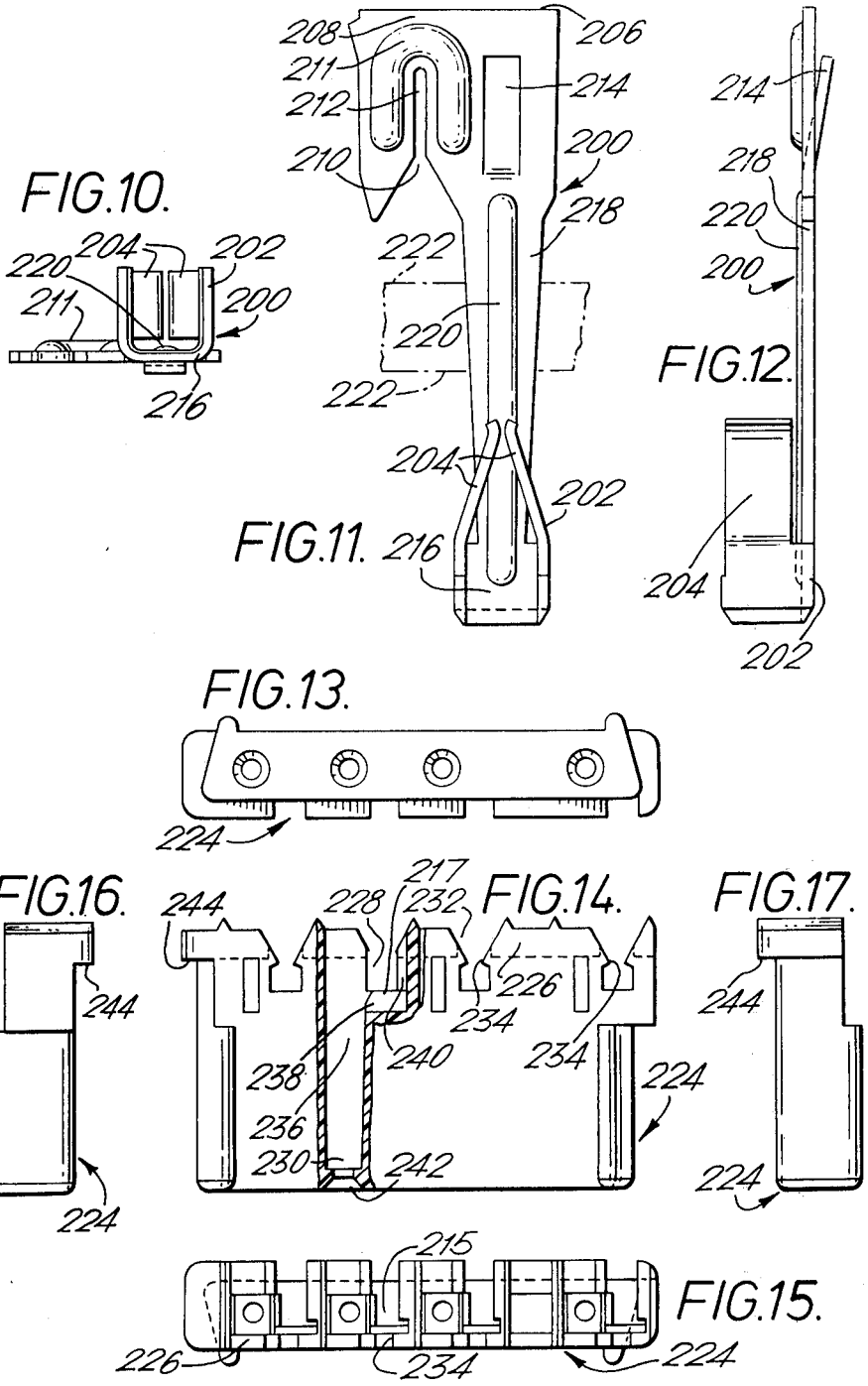
FIGS. 10 to 12 are enlarged underplan, front and side views, respectively, of an alternative form of electrical terminal for carrying out a harness making method according to the invention.
FIGS. 13 to 17 are an underplan, an elevation, shown partly in section, a top plan, and two opposite end views, respectively, or an insulating connector housing for receiving electrical terminals according to FIGS. 10 and 12.

The method of harness making just described may be carried out by means of the apparatus shown in FIG. 9, which comprises an endless rail 180 which guides a series of trolleys 182 each supporting a block 104 and board 106. Each assembly 104, 106 shown in full lines is positioned at a working station, these being referended M to S, respectively, each assembly 104, 106 shown in broken lines being at a buffer (non-working) station X, the working and the buffer stations being positioned alternately about the rail 180. In operation of the apparatus, the assemblies 104, 106 are advanced along the rail 180 intermittently in the direction indicated by the arrow C in FIG. 9. The presence of the buffer stations obviates the need for moving the assemblies simultaneously, the total number of assemblies mounted to the conveyor comprised by the rail 180 and the trolleys 182 being eight.

At station M, housings 102 are loaded into the recesses 103 for example, in cartridge form as described above with reference to FIG. 8, or automatically by means of a vibratory bowl feeding device (not shown).

At station N, cut and stripped shielded wires are dressed manually with the aid of the posts 108.

At stations L, O and P insulated wires drawn from spools 164 (see FIG. 5) and dressed manually about the posts 108 and are loaded into the housings 102, the shielded wires also being so loaded and all the loaded wires being trimmed as described above.

At station Q, the bundle ties 176 are secured about the wires, for example, by means of an automatic tool (not shown). Alternately, for example, tape could be employed for securing the wires together.

At station R, the inserter 168 is employed to insert the terminals 112 into the housings 102 at the positions at which the housings have been loaded with wire.

At station S, the completed harness is tested by means, for example, of test probes (not shown) inserted, from beneath, into the receptacle portions 116 of the inserted terminals, via the holes 158, and the completed harness is then removed from the assembly 104, 106 at the station S.

An alternative form of connector for use in the harness making methods described above, will now be described with reference to FIGS. 10 to 17.

A terminal 200 (FIGS. 10 to 12) which has been stamped and formed from a single piece of metal, consists of a receptacle portion 202 for receiving a male terminal member (not shown) in the form, for example, of a pin or post and a wire connecting portion 206 comprising a plate 208 provided with a slot opening into an edge of the plate 208. The slot comprises a flared mouth 210 merging into a narrower conductor gripping portion 212 of constant width. The plate 208 has a U-shaped stiffening rib 211 surrounding the portion 212 of the slot. A locking lance 214 struck out from the plate 208 is axially aligned with the receptacle portion 202 and is directed obliquely away therefrom.

The receptacle portion 202 comprises a pair of opposed contact springs 204 formed as extensions of the arms of a U-cross-section support member 216, the contact springs 204 converging towards the plate 208. The member 216 is connected to the plate 208 by a rigid support arm 218 having a central longitudinal stiffening rib 220. The terminal 200 is connected with other and similar terminals to form a strip by metal slugs 222 shown in broken lines.

A housing 224 (FIGS. 13 to 17) comprises a sidewall 226 which projects above the upper surface of the housing, and is provided with wire receiving notches 228, each aligned with one of irregularly spaced terminal receiving openings 230 and opening away from the housing 224, each notch 228 having a flared mouth 232, and defining a pair of opposed wire retaining projections 234 at the base of the mouth 232. Each opening 230 comprises a deeper first portion 236 for receiving the portion 202 and arm 218 of a terminal 200 and a shallower slot portion 238 for receiving the slotted part of the plate 208, such portion 238 being in the form of a rectangular slot which is substantially narrower than the portion 236, and is adapted snugly to receive the rib 211 of the terminal 200. A shoulder 240 of the housing projects across the opening portion 238.

The opening portion 236 communicates at its lower end with the exterior of the housing via a funnel shaped hole 242 for the male terminal member. During insertion of a terminal 200, a wire extending through the notch 228 asssociated with an opening 230 is captured by the mouth 210 of the plate 208 of the terminal 220 and is forced into the slot portion 212 by an abutment surface 215 of the housing and base 217 of the notch so that the walls of such portion pierce the insulation of the wire and grip the electrically conductive core of the wire from either side, the rib 211 serving to augment the gripping action of the slot walls against the core of the wire. Also during the insertion of the terminal, the locking lance 214 thereof is depressed resiliently towards the plate 208 and finally resiles so that its free end latches against the shoulder 240, whereby the terminal is securely fixed in position in the opening so that permanent electrical connection between the wire core and the terminal is ensured.

The housing 224 has a shoulder 244 for engaging the upper surface of the block 104 when the housing has been inserted into a recess 103 thereof, and for engagement with the clip 178 to secure the housing therein.

What is claimed is:

1. A method of manufacturing an electrical harness comprising wires connected to electrical terminals of a plurality of electrical connectors, according to a desired wiring pattern, each terminal comprising a wire connecting portion formed integrally with a contact portion for mating with a complementary electrical terminal member, in which method, the wires are laid out on a wiring layout board, with the aid of wire guiding means, to form the desired wiring pattern and are subsequently connected electrically, to the terminals of the connectors, the wire being first laid in notches in the housings of the connectors, which housings are disposed on the board, after which the terminals are inserted into through openings in the housings through first ends of the openings, electrically to connect the wires to the wire connecting portions of the terminals and are secured in the openings with the contact portions of the terminals positioned to receive mating terminal members inserted through second ends of the openings in the housings.

2. A method according to claim 1, in which the housings are arranged in a row on the board in constantly spaced relationship and the board is advanced step-by-step towards a terminal inserter which inserts terminals simultaneously into a plurality of the openings in each housing in turn.

3. A method according to claim 1, in which the wires are insulated wires and the terminals are provided with means for piercing the insulation of the wires as the terminals ae inserted into the openings.

4. A method according to claim 1, in which the first ends of the openings in the housings are presented one by one to a terminal inserter which is operated intermittently, to insert one terminal into an opening at each operation of the inserter.

5. A method according to claim 4, in which the housings are positioned in recesses in a support block secured to the wiring layout board and which is advanced intermittently beneath an insertion head of the terminal inserter in conformity with the spacing between the openings, which spacing is irregular.

6. A method according to claim 5, in which the support block and wiring layout board are intermittently advanced by means of a conveyor successively to; a first working station at which the housings are loaded into the recesses of the support block; to second working stations at which the wires are dressed to form the desired wiring pattern with the aid of the guiding means and at which the wires are laid in the notches of the housings; to a third working station at which the terminals are inserted into the openings in the housings; and to a fourth working station at which the finished harness is electrically tested and is removed from the support block and wiring layout board, buffer stations at which no operations are performed being arranged between the working stations.

7. A method according to claim 5, in which the housings ar secured together by means of an elongate resilient clip to form a cartridge, with the housings spaced lengthwise of the clip in conformity with the spacing between the recesses of the support block, whereafter the housings are inserted into the recesses and the clip is removed prior to the wires being inserted into the notches of the housings.

* * * * *